US009803365B2

(12) United States Patent
Peltier

(10) Patent No.: US 9,803,365 B2
(45) Date of Patent: Oct. 31, 2017

(54) LIGHTWEIGHT SEMI-PERMANENT TRUSS SYSTEM

(71) Applicant: Carl Peltier, Branch, LA (US)

(72) Inventor: Carl Peltier, Branch, LA (US)

( * ) Notice: Subject to any disclaimer, the term of this patent is extended or adjusted under 35 U.S.C. 154(b) by 0 days.

(21) Appl. No.: 15/265,661

(22) Filed: Sep. 14, 2016

(65) Prior Publication Data

US 2017/0073971 A1 Mar. 16, 2017

Related U.S. Application Data

(60) Provisional application No. 62/218,402, filed on Sep. 14, 2015.

(51) Int. Cl.

| | |
|---|---|
| ***E04C 3/08*** | (2006.01) |
| ***E04C 3/09*** | (2006.01) |
| ***E04B 1/19*** | (2006.01) |
| ***E04C 3/04*** | (2006.01) |
| ***E04C 3/28*** | (2006.01) |
| ***E04C 3/32*** | (2006.01) |
| ***E04C 3/36*** | (2006.01) |
| ***A47B 55/00*** | (2006.01) |

(52) U.S. Cl.

CPC ..... *E04C 3/083* (2013.01); *A47B 55/00* (2013.01); *E04C 3/04* (2013.01); *E04C 3/09* (2013.01); *E04C 3/28* (2013.01); *E04C 3/32* (2013.01); *E04C 3/36* (2013.01); *E04C 2003/0404* (2013.01)

(58) Field of Classification Search

CPC ... E04C 3/083; E04C 3/09; E04C 3/04; E04C 3/32; E04C 3/36; E04C 3/28; E04C 2003/0404; E04B 1/1903; E04B 2001/193; E04B 2001/1957; A47B 55/00

USPC .... 52/655.1, 690, 653.1, 836, 839, 843, 848

See application file for complete search history.

(56) References Cited

U.S. PATENT DOCUMENTS

| | | | | | |
|---|---|---|---|---|---|
| 1,656,810 | A * | 1/1928 | Arnstein | B64C 1/065 | 52/634 |
| 2,936,051 | A * | 5/1960 | Martin | E04B 1/24 | 52/650.1 |
| 3,063,523 | A * | 11/1962 | Triplett | B66C 23/70 | 403/8 |
| 3,104,454 | A * | 9/1963 | Sparkia | E04C 3/08 | 29/521 |
| 3,989,396 | A * | 11/1976 | Matsumoto | E04B 1/2403 | 29/463 |
| 4,593,514 | A * | 6/1986 | Smith | E04B 1/19 | 403/171 |
| 4,964,256 | A * | 10/1990 | McCracken | B21D 47/01 | 29/897.34 |

(Continued)

*Primary Examiner* — Brent W Herring

(57) ABSTRACT

A truss support system is disclosed. The system is comprised of a plurality of tubular truss sections configured for attachment to each other. Each of the sections has a plurality of polygonal shaped access slots surrounded by a plurality of bolt holes along each of its peripheral sides and on end-plates at each end of the truss sections. The end-plates of the system have additional bolt holes around the access slot compared to the number of bolts surrounding the access slots on the peripheral sides to provide for increased hold between end-to-end connections of truss sections. The truss sections of the system may be hinged together to compensate for uneven ground or for increased load supported.

9 Claims, 8 Drawing Sheets

(56) References Cited

U.S. PATENT DOCUMENTS 5,426,906 A * 6/1995 McCracken ..... E04C 3/07 52/474
5,527,625 A * 6/1996 Bodnar ..... E04C 3/065 428/595
5,551,199 A * 9/1996 Hayes ..... F21S 2/00 362/249.09
5,678,375 A * 10/1997 Juola ..... E04B 1/24 52/236.7
5,743,060 A * 4/1998 Hayes ..... F21S 2/00 362/249.09
6,802,170 B2 * 10/2004 Davis ..... E04C 3/07 29/897.31
6,837,446 B1 * 1/2005 Jesse ..... A01C 23/008 239/159
7,051,488 B2 * 5/2006 Nelson ..... E04B 1/161 52/481.1
7,155,874 B2 * 1/2007 Lee ..... E04B 1/24 52/843
7,464,513 B2 * 12/2008 Rioux ..... E04H 12/08 52/651.01
7,707,780 B2 * 5/2010 Ouellet ..... E04L 35/10 52/126.5
8,418,425 B1 * 4/2013 Santini ..... E04H 3/28 52/653.1
8,484,930 B2 * 7/2013 Ruehl ..... B62D 21/00 280/797
8,695,305 B2 * 4/2014 Gallagher ..... E04H 12/2238 52/655.1
9,212,491 B1 * 12/2015 Santini ..... E04F 11/035
2002/0005022 A1 * 1/2002 Matthews ..... E04B 5/10 52/483.1
2003/0126827 A1 * 7/2003 Davis ..... E04C 3/07 52/843
2003/0184075 A1 * 10/2003 Freeman ..... B62D 21/00 280/797
2004/0093825 A1 * 5/2004 Lee ..... E04B 1/24 52/843
2004/0211149 A1 * 10/2004 Rioux ..... E04H 12/08 52/848
2006/0185258 A1 * 8/2006 Ouellet ..... E04B 5/10 52/7
2006/0277859 A1 * 12/2006 Egli ..... E06B 3/26305 52/843
2007/0107368 A1 * 5/2007 Ruehl ..... B62D 21/00 52/843
2008/0028721 A1 * 2/2008 Daniels ..... A47B 96/1458 52/843
2010/0071141 A1 * 3/2010 Reiner ..... E01D 15/124 14/73
2013/0167468 A1 * 7/2013 Gallagher ..... E04H 12/2238 52/655.1
2014/0250820 A1 * 9/2014 Richardson ..... E04C 3/08 52/634

* cited by examiner

LIGHTWEIGHT SEMI-PERMANENT TRUSS SYSTEM

This application claims priority to U.S. provisional application Ser. No. 62/218,402 filed Sep. 14, 2015, the entire content of which is hereby incorporated by reference.

FIELD OF INVENTION

This invention relates to a truss system to provide for construction of semi-permanent structures such as frameworks and the like and more particularly to a structural system which allows for attachment of truss sections at desired places and orientation along any section of an adjacent truss section.

BACKGROUND OF INVENTION

In numerous industries it is necessary to erect semi-permanent structures both internally as well as externally in order to permit workers to stand at an elevation above the ground surface or to suspend structures and things above the ground. Often times these temporary structures are hollow lengths of piping or tubing erected by interconnection end to end with other hollow sections, thus limiting the area upon which other connections may be made to further build the structure or connect an object to be suspended therefrom. Such prior art structures, being mainly comprised of long solid materials which may be only attached at joints between two adjoining ends of each section require connection by extensive welding between sections or insubstantial connection by through running bolts.

Due to the requirement that the support structure provide adequate support under load, prior art support structures generally are comprised of solid girders or hollow tubular members. Providing a solid support structure limits the ability of personnel to access within the hollow sections to bolt segments together from within. Rather, with such structural members, sections are connected by running a bolt completely through adjoining sections, wasting valuable space within the hollow segment where additional connections could have been made.

Furthermore, when bolts are employed for the purpose of attaching prior art support sections in an end-to-end relationship, the teaching is to apply the same number of attachment bolts as would be applied in attaching segments in a perpendicular cross member arrangement. Support segments placed in an end-to-end arrangement are subjected to a considerable amount of flexing stress which could cause a break or shearing of the support structure if a failure should occur. In the event of a structural failure, there is a considerable risk of damage to equipment and a high risk of injury or death to personnel.

Accordingly, there is a need in the art for a semi-permanent tubular support structure which allows for a plurality of connections to be made both between each adjoining section and along the external periphery of each section, wherein each end-plate employs additional connections to resist structural failure.

SUMMARY OF INVENTION

The present invention provides a semi-permanent structural truss system to provide a support system for creation of a load bearing assembly. The apparatus described includes tubular truss sections having a plurality of access slots to allow passage of hands and arms of personnel into the inner region of the truss section to ease connection between truss sections. A plurality of bolt holes are also provided around each access slot to permit connection of adjacent truss sections as desired.

The truss sections further comprise end-plates having access slots and additional bolt holes. Additional bolt holes are provided on the end-plates to aid in attachment and support between end sections or to the peripheral sides of adjacent truss sections. The end-plates may alternatively be configured as a pivotal plate to allow truss sections to be angled in relation to one another or to compensate for uneven ground or movement of the structure. Brackets may be added to facilitate the connection of truss sections.

The portability and ease of installation and setup of the structural truss system is particularly suitable for use in construction or other industry where temporary support structures are required. Because the sections may be configured to pivot up and down on hinges, the framework structures created by the truss sections may be attached between other sections as desired to provide support between perpendicularly attached sections. This feature further allows the truss sections to compensate due to uneven ground or added load upon the support structure.

The tubular character of each truss section is formed by joining together two formed half-sections of structural plate, each being pre-formed with a flat central surface and outer ends that fold upward along a joint line to form the half-member into a channel or U-shape. The outer ends of each half-section are provided with a plurality of half-slots that create the access slots, preferably polygonal-shaped access slots, when the half-slots of one U-shaped half-member are placed to coincide with the U-shaped half-slots of the other U-shaped half-member. When two members are oriented upon each other the abutting half slots create the desired access slots, the adjoining half-members are welded at their intersection to create the tubular section. Because the intersection of the half-members is interrupted by the access slots created by the abutting half-members, amount of welding required to connect the plates is substantially reduced. This method of construction provides a distinct advantage when compared to the construction of similar structural members which require welding along the entire length of each member when forming a tube section.

It is thought that each of the truss sections of the system will be constructed from structural aluminum or structural steel plate, however other types of materials and metals might be utilized to construct the sections, including polymer materials, all depending upon the intended use of the system.

DESCRIPTION OF THE EMBODIMENT

Figure 1:
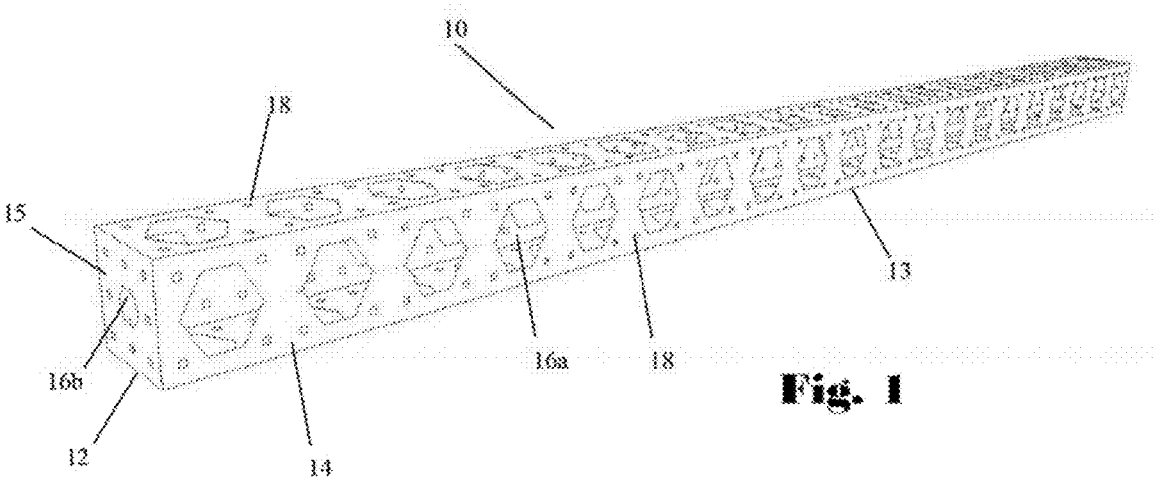
FIG. 1 is a perspective view of the interconnected truss system of the present invention.
Figure 2:
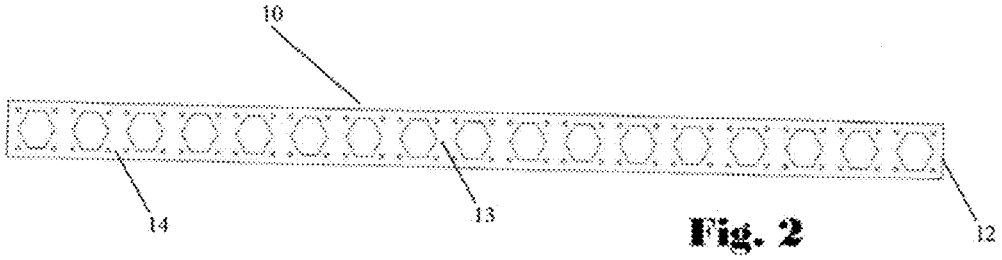
FIG. 2 is side view of the interconnected truss system of FIG. 1
Figure 3:
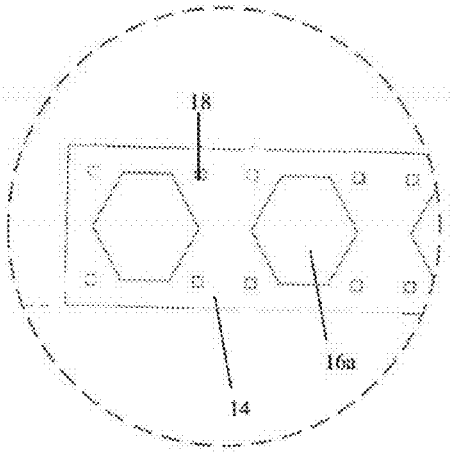
FIG. 3 is a focused view of the peripheral side of the interconnected truss system of FIG. 2.

One embodiment of the semi-permanent truss structural system (10) is shown in a perspective view in FIG. 1 and in a side view in FIGS. 2 & 3. The truss system (10) comprises a plurality of variously configured elongate tubular truss sections (14) each having first and second ends (12) and a peripheral side (13). The truss sections (14) are preferably elongate, hollow, rectangular tubes with end-plates (15) for attachment to other sections (14). Each such truss section (14) has a plurality of polygonal shaped access slots (16*a*) which allow for reaching within truss section (14). The polygonal shaped slots (16*a*) are spaced at equal distances along the longitudinal length of the peripheral sides (13) of truss sections (14) and are of sufficient size to allow for ease of passage of the hand and arm of personnel into the central hollow interior (11) of truss section (14) to facilitate access for fastening of bolts (30) through bolt holes (18).

Figure 5:
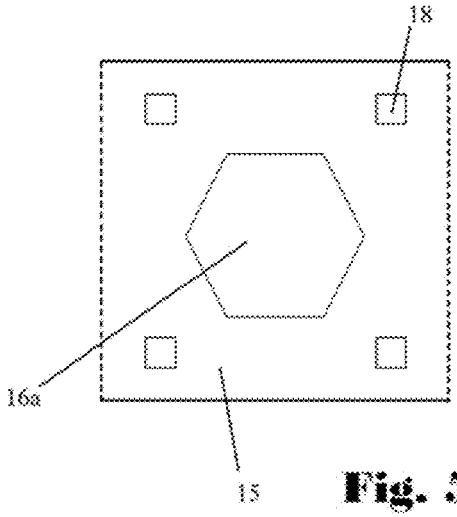
FIG. 5 is a front view of the slot and bolt hole pattern of the peripheral side of the interconnected truss system.

As can be seen in FIG. 5, showing a view of single iteration of the repeated pattern on peripheral side (13), the peripheral sides (13) are comprised of a plurality of a repeated patterns of slots (16*a*) surrounded by a number of bolt holes (18) arranged in a uniform pattern in relation to each slot (16*a*).

Figure 4:
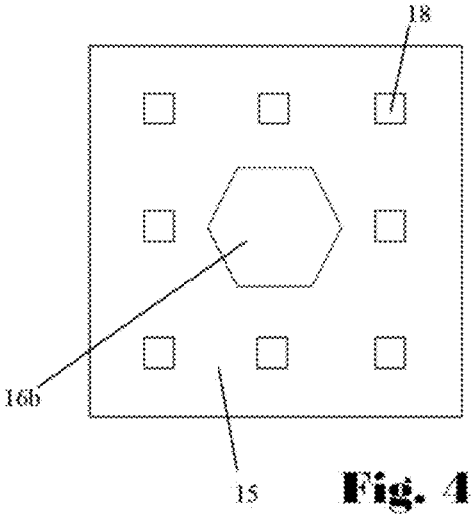
FIG. 4 is a front view of the end-plate of the interconnected truss system.

As shown in FIG. 4, end-plates (15) comprise a polygonal shaped access slot (16*b*), similar to that of slot (16*a*) on peripheral side (13) of truss section (14), which also have a plurality of bolt holes (18). The polygonal shaped access slots (16*b*) and bolt holes (18) on end-plates (15) allow the end-plates (15) on ends (12) of adjacent truss sections (14) to be attached together to provide a desired length of successive truss sections (14). The end-plate (15) of a truss section (14) may also be attached to a peripheral side (13) of an adjacent section (14) by a bolt (30) through the aligned bolt holes (18) to create intersecting truss sections (14). Access slots (16*a*, 16*b*) provide access to the hollow interior area (11) of the truss section (14) to allow bolting of each truss section (14) together without the necessity of running bolt (30) through the entire section (14).

Due to the anticipated load stresses that occur at the connection of ends (12) when attaching two truss sections (14) in an end-to-end orientation, end-plates (15) are provided with additional bolt holes (18) to allow additional attachment bolts (30) to be provided to increase the load capacity of connections where such sections (14) are linked together. Additional bolt holes (18) on the end-plates (15) allow stronger connections between adjoining end-plates (15), which tend to receive added flex stresses due to the increased length of the resulting truss member created when multiple sections (14) are joined together. This is advantageous as the additional load capacity provide by additional bolts aids in resisting structural failure due to such flexing stresses.

While preferably each truss section (14) has four peripheral sides (13) to create the tubular shape of truss section (14) with sufficient area within the segment to allow for access, it is envisioned that each section could be created with as little as three peripheral sides or more than four peripheral sides depending upon spacial needs required for connection.

An end-plate (15), as shown in FIG. 4, on an end (12) of an adjacent truss section (14) may be attached to another end-plate (15) on an end (12) of an adjacent truss section (14), wherein a line of truss sections (14) may be created in an end-to-end relation. In such an arrangement, the additional bolt holes (18) provided on end-plates (15) will provide added hold between the individual truss sections (14). Further, end-plates (15) may be attached to the bolt holes (18) along peripheral side (13), wherein a junction of truss sections (14) may be created perpendicular in relation to one another.

Two peripheral sides (13) of adjacent sections (14) may also be attached to one another in a parallel or perpendicular running orientation, wherein the two adjacent truss sections (14) are attached to each other via the bolt holes (18) provided on peripheral sides (13) of both adjacent truss sections (14). It is envisioned that attaching adjacent sections (14) in a parallel orientation will create a stronger support member capable of retaining a greater amount of weight. Furthermore, attaching adjacent truss sections (14) in a perpendicular orientation can be done to create scaffolding legs or a traverse between additional lines of sections (14).

Figure 6:
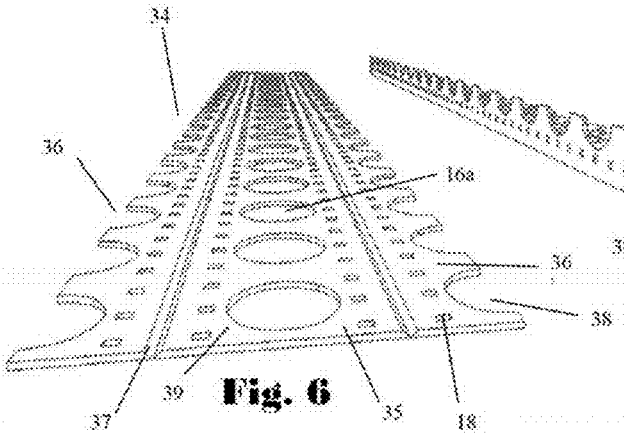
FIG. 6 is a perspective view of the half section member component of the interconnected truss system in a flat position.
Figure 8:
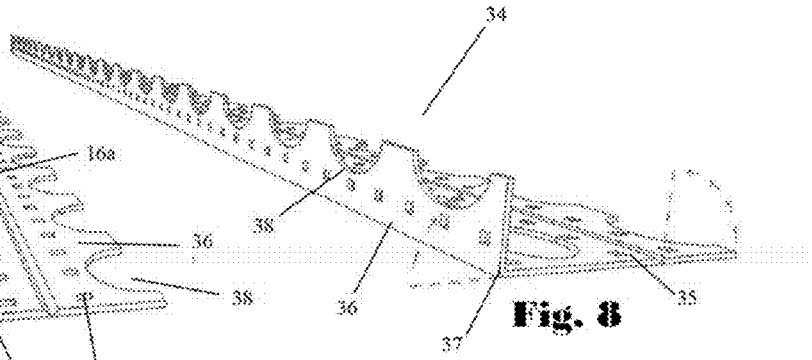
FIG. 8 is a perspective view of the half section member component of the interconnected truss system in a folded position.
Figure 7:
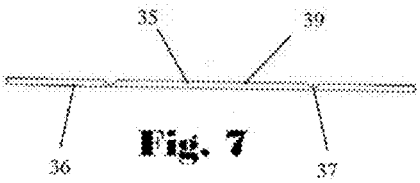
FIG. 7 is a side view of the half section member component of the interconnected truss system in a flat position as shown in FIG. 6.
Figure 9:
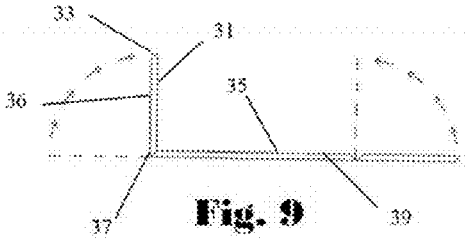
FIG. 9 is a side view of the half section member component of the interconnected truss system in a folded position as shown in FIG. 8.
Figure 10:
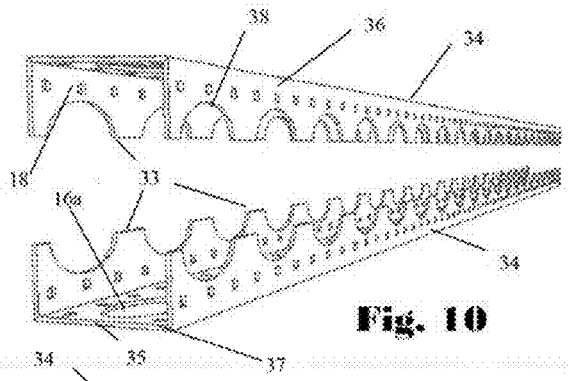
FIG. 10 is a perspective view of the orientation of two half section members for formation of the interconnected truss system.

FIGS. 6-13 show the creation of a truss section (14). Each truss section (14) is created by joining together half-sections of U-shaped plate members (34). As shown in FIG. 6, each U-shaped plate member (34) is formed of a plate (39) that has a central surface (35) and outer wings (36). Preferably first and second fold-lines or joints (37) are provided between central surface (35) and outer wings (36). The joints (37) allow outer wings (36) of the plate (39) to fold upward to form a U-shaped plate member (34) having outer flanges (31) with flange ends (33). Central surface (35) of each U-shaped plate member (34) is provided with a plurality of the fully shaped equally spaced slots (16*a*) which run along its length. The outer wings (36) creating the flanges (31) of the U-shaped plate members (34) are provided with a plurality of equally spaced slots half-slots (38) on the flanges (31) of the U-shaped plate member which are formed to create the polygonal shaped slot (16*a*) when the half-slots (38) of one U-shaped plate member (34) is the placed in relation to the half-slots (38) of another U-shaped plate member (34). Bolt holes (18) are provided through member (34) in order to create the pattern of slots (16*a*) and bolt holes (18) in the completed tubular truss section (14).

The plate (39) used to form the U-shaped plate members (34) is preferably structural aluminum or aluminum alloys though any suitable metal such as stainless steel, carbon steel, steel alloys, or other metal alloys could also be utilized. The U-shaped plate members (34), depending upon their anticipated uses, could also be constructed of structural polymers. The bolt holes, (18), slots (16*a*), and half-slots (38) in each U-shaped plate member (34) are preferably laser cut but could also be formed by machining, milling, stamping, flame cutting, or water jetting.

Now referring to FIGS. 10-13, a truss section (14) is formed by placing two U-shaped plate members (34) together to abut their opposing flange ends (33) in an mirror arrangement to create a the hollow central interior (11). In U-shaped placing members (34) together, half-slots (38) on the outer wings (36) forming the flanges (31) and flange ends (33) of U-shaped plate members (34) are placed together to create the desired polygonal shape forming slots (16*a*).

The intersection of the opposing flange ends (33) of the U-shaped plate members (34) create a weld line (40) along the flange ends (33) of between the half-slots (38) creating slots (16*a*) that reduces the welding necessary to join the two U-shaped plate members (34) together to form the tubular truss section (14). Unlike conventional methods of forming a tubular truss, where welding occurs along the entire length of the truss member, the orientation of the half-slots (38) as described creates numerous breaks along the length of the truss section (14), thus welding on weld line (40) is only required along the flange ends (33) between each half-slot (38).

Figure 20:
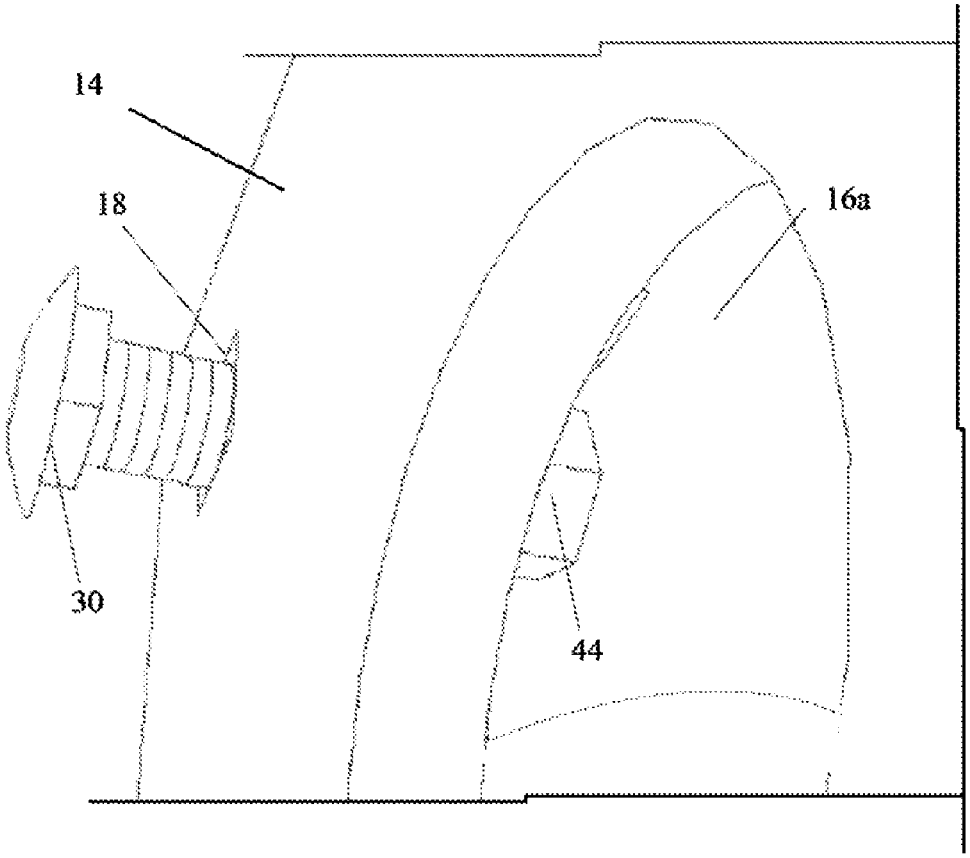
FIG. 20 is a perspective view of a bolt connection through the bolt holes of the present invention.

Now referring to FIG. 20, a connection may be created between two truss sections (14) by alignment of the bolt holes (18) of each adjoining truss section (14) and passage of bolt (30) through the aligned bolt holes (18). Once placed there through, bolts (30) may be secured by affixing a lock nut (44). Access is readily available to secure lock nut (44) through slots (16*a*, 16*b*). By orientation of the bolt holes (18) on truss sections (14) and those of end-plates (15), a series of adjacent truss sections (14) may be joined and held securely together.

Figure 14A:
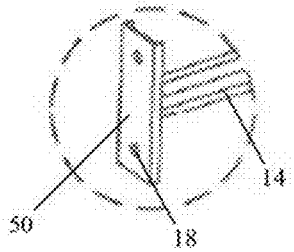
FIG. 14*a* is a perspective view of the bracket end-plate embodiment of the present invention.
Figure 14B:
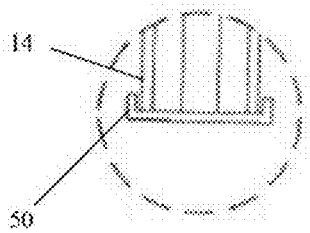
FIG. 14*b* is a side view of the bracket end-plate embodiment of the present invention shown in FIG. 14*a*.

Now referring to FIGS. 14*a* and 14*b*, the truss section (14) may be provided with an bracket (50) fixedly attached to an end (12) as an alternate embodiment of end-plate (15). Bracket (50) is provided with bolt holes (18) to facilitate attachment to the bolt holes (18) of an adjacent truss section (14). Though pictured in FIG. 14*a* as having two bolt holes (18), it is envisioned that any number of bolt holes (18) may be provided to facilitate attachment and support.

Figure 15A:
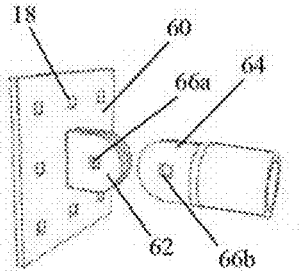
FIG. 15*a* is a perspective view of the pivotal end-plate embodiment of the present invention.
Figure 15B:
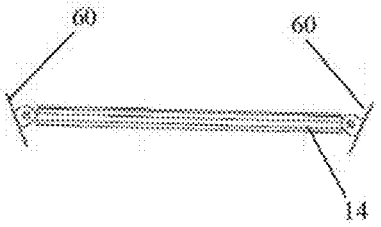
FIG. 15*b* is a side view of the pivotal end-plate embodiment of the present invention shown in FIG. 15*a*.
Figure 16:
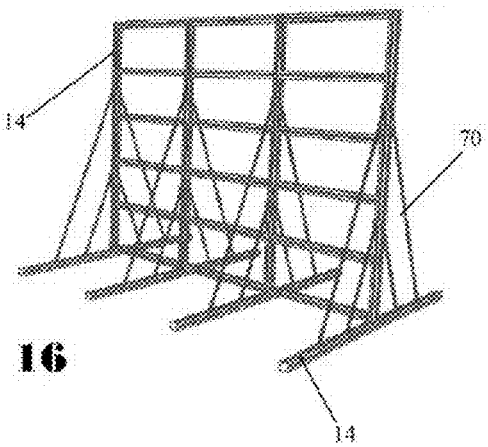
FIG. 16 is a perspective view of a free standing framework assembled by the interconnected truss system.
Figure 17:
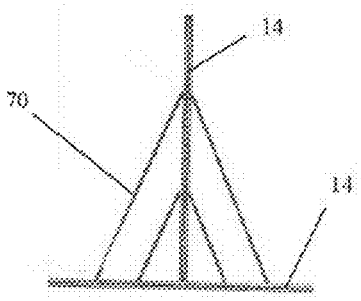
FIG. 17 is a side view of a free standing framework assembled by the interconnected truss system shown in FIG. 16.
Figure 18:
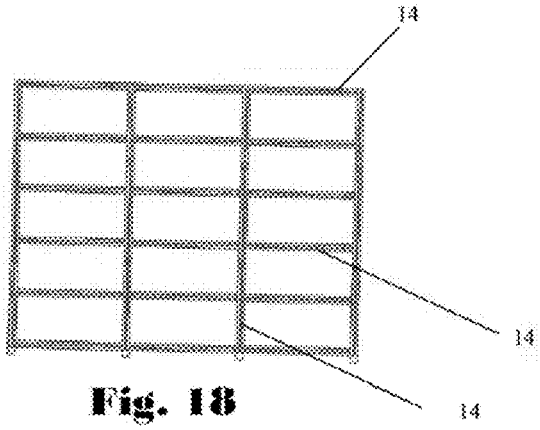
FIG. 18 is a top view of a lattice framework assembled by the interconnected truss system.
Figure 19:
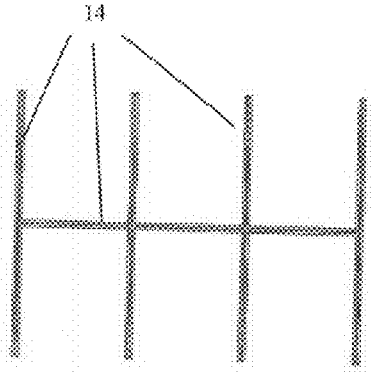
FIG. 19 is a top view of a branching framework assembled by the interconnected truss system.

Referring now to FIGS. 15*a* and 15*b*, another embodiment of the truss structural system (10) comprises providing a pivot plate (60) in place of end-plate (15). The pivotal mount (62) of pivotal plate (60) is connected to an end (12) of truss section (14) by means of hinge (64). The hinged connection of the pivot plate (60) to truss section (14) allows the pivot plates (60) to be pivoted on hinge (64) to allow for varied angular orientation and connection between adjacent sections (14). Similar to end-plate (15), pivot plate (60) is also provided with a plurality of bolt holes (18) to allow for fixed attachment to an adjacent truss section (14).

Pivotal mount (62) comprises a dual blade attachment configuration to allow sliding passage of the single blade configuration of hinge (64) on truss section (14) for alignment of pivotal bolt holes (66*a*) on pivotal mount (62) and hinge bolt holes (66*b*) on hinge (64). Pivotal mount (62) and binge (64) may be pivotally attached by passage of a bolt, lock-nut, pin, or other attachment structure conventional in the art through the pivotal bolt holes (66*a*) and hinge bolt holes (66*b*) of pivotal mount (62) and hinge (64), respectively, to allow for pivotal movement between pivot plate (60) and truss section (14). By way of example, a truss structural system (10) may be modified to provide a flexible frame consisting of truss sections (14) which form a latticework pivotally attached by hinges (64). It is thought that pivotally attaching the truss sections (14) will allow a structure to be more effectively used in areas where the ground surface is uneven. Pivotally attaching the truss sections (14) will also allow for the creation of an A-frame structure comprised of interconnected truss sections (14). The angle of pivot of the truss sections (14) with respect to each other may be varied as desired.

Figure 11:
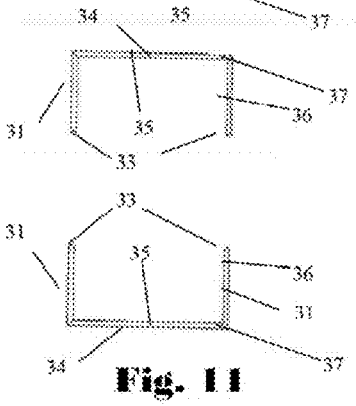
FIG. 11 is a side view of the orientation of two half section members for formation of the interconnected truss system.
Figure 12:
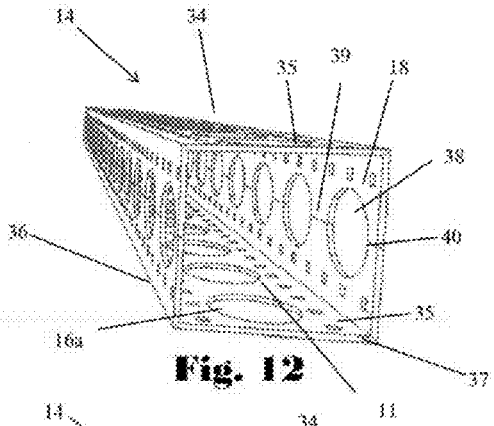
FIG. 12 is a perspective view of the welded connection of two half section members formation of the interconnected truss system.
Figure 13:
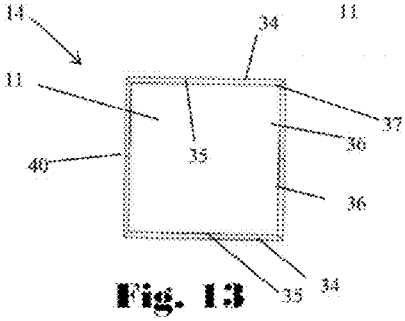
FIG. 13 is a side view of the welded connection of two half section members formation of the interconnected truss system.

As shown in the cross-sectional views, FIGS. 11 and 13, each truss section (14) is configured as an elongated box having sidewalls created by central surfaces (35) and the intersection of the flange ends (33) of adjoining U-shaped plate members (34). The tubular shape of the truss sections (14) provides for added space for access through slots (16*a*, 16*b*) for securing bolts (30). The truss sections (14), including the end-plates (15), brackets (50), and pivot plates (60), are configured to support the weight of heavy equipment and structures that may be attached to or suspended from the truss sections (14). Though slots (16*a*, 16*b*) are shown as hexagonal shaped openings running through section (14) it is thought that other polygonal shapes or circular type slot shapes could be utilized.

Examples of the structural frameworks which may be created by use truss sections (14) is shown in detail in FIGS. 16, 17, 18, and 19. One or more of the truss sections (14) may be configured together as desired to form a structure of desired strength and stability. Being variously configurable for attachment to one another, the truss sections (14) may be fixed to create structural bases (FIG. 19), free-standing frames (FIGS. 16 & 17), or a latticework (FIG. 18) of interconnected truss sections (14). Truss sections (14) may be attached linearly in an end-to-end arrangement of adjacent sections (14) by attachment to either an end-plate (15) or bracket (50), for a fixed structural arrangement, or with pivot plates (60), for a flexible arrangement. A junction may also be created by attachment of an end (12) of a truss section (14) to a peripheral side (13) of an adjacent truss section (14).

In use, cables (70) or additional truss sections (14), pivotally attached or otherwise, may be provided for added structural support when creating a free standing structure or for allowing for suspension of equipment and personnel from the formed structure. Cables (70) may be attached via access slots (16*a*, 16*b*) or may be attached to bolt holes (18) as necessary to provide for sufficient support.

It is thought that the truss structural system (10) and the method of the present invention and many of its attendant advantages will be understood from the foregoing description. It is also thought that one may make various changes in the form, construction and arrangement of the parts of the sections and system without sacrificing its material advantages or departing from the spirit and scope of the invention and that the form described herein is merely an exemplary embodiment of the invention.

I claim:

1. A method of creating a semi-permanent structural support member comprising the steps of:

a. providing:

i. first and second half-sections of plate, each said half-section of plate having a central surface and two outer wings, said central surface and said outer wings running the longitudinal length of each said half-section of plate, each said half-section of plate having a joint running between said central surface and each said outer wing;

ii. a plurality of polygonal-shaped slots along said central surface of each said half-section of plate, wherein each said polygonal-shaped slot has a plurality of surrounding bolt holes arranged in a uniform pattern;

iii. a plurality of half polygonal-shaped slots along each said outer wing of each said half-section of plate; and iv. wherein each said half polygonal-shaped slot has a plurality of surrounding bolt holes arranged in a uniform pattern;

b. folding each said outer wing of each said half-section of plate upwardly along said joint thereby creating first and second U-shaped plate members having upwardly extending outer flanges with each said outer flange having a flange end;

c. abutting said flange ends of said outer flanges of said first U-shaped plate member against said flange ends of said outer flanges of said second U-shaped plate member, whereby said adjacent half polygonal-shaped slots of said abutting outer flanges of said first and second U-shaped plate members are oriented to form a polygonal-shaped slot and whereby abutting said flange ends of said outer flanges of said first and second U-shaped plate members form a weld line; and d. welding along said weld line to form a tubular rectangular support member having a hollow interior, first and second ends, and peripheral sides with a plurality of said polygonal-shaped slots, wherein said bolt holes are arranged in a uniform repeated pattern in relation to each said polygonal-shaped slot created by said adjacent half polygonal-shaped slots and said abutting outer flanges of said first and second U-shaped plate members;

providing an end-plate upon said first and said second end of said formed tubular support member;

wherein each end-plate has an end-plate polygonal-shaped slot and a plurality of end-plate bolt holes in a quantity greater than said bolt holes arranged in a uniform repeated pattern in relation to each said polygonal-shaped slot on said peripheral sides of said formed tubular support member.

2. The method of creating a semi-permanent structural support member of claim 1, further comprising the steps of providing a pivotable hinge at each said end-plate.

3. The method of creating a semi-permanent structural support member of claim 1, wherein said end-plate is a bracket.

4. A method of constructing a semi-permanent structural support system comprising the steps of:

a. providing:

i. a plurality elongate hollow tubular truss sections having peripheral sides and first and second ends, each said tubular truss section comprised entirely of first and second U-shaped plates, said first and second U-shaped plates having a pair of extending outer flanges, each said outer flange having a flange end, said flange ends of said first and second U-shaped plates abutting against each other and welded together at said abutting flange ends;

ii. each said elongate tubular truss section having a plurality of polygonal-shaped access slots arranged along said peripheral sides of said elongate tubular truss section;

iii. wherein each said polygonal-shaped shaped access slot on said peripheral sides has an array of corresponding bolt holes arranged in a uniform pattern in relation to each said polygonal-shaped access slot; and iv. an end-plate upon each said first end and each said second end of each said elongate hollow tubular truss section, wherein each said end-plate has an end-plate polygonal-shaped access slot and a plurality of end-plate bolt holes in a quantity greater than that of said bolt holes arrayed with each said polygonal-shaped access slot on said peripheral sides of said elongate tubular truss section;

b. selecting first and second said elongate hollow tubular truss sections from said plurality of elongate hollow tubular truss sections;

c. orienting said end-plate of said first elongate hollow tubular truss section wherein said polygonal shaped slot and said bolt holes of said end-plate of said first elongate hollow tubular truss section align with selected said polygonal shaped slot and said bolt holes of said second elongate hollow tubular truss section; and d. fastening a bolt through each aligned said bolt hole to affix said first elongate hollow tubular truss section to said second elongate hollow tubular truss section.

5. The method of constructing a semi-permanent structural support system of claim 4, wherein said end-plates of said first or said second ends of said first elongate hollow tubular truss section may be attached to said peripheral side or said first or second ends of said second elongate hollow tubular truss section.

6. The method of constructing a semi-permanent structural support system of claim 5, wherein one of said peripheral sides of said first elongate hollow tubular truss section may be attached to one of said peripheral sides of said second elongate hollow tubular truss section.

7. The method of constructing a semi-permanent structural support system of claim 6, further comprising the step of connecting cables between said first and said second elongate hollow tubular truss sections.

8. The method of constructing a semi-permanent structural support systems of claim 7, further comprising the step of providing a hinge between said ends and said end-plates of each said elongate hollow tubular truss section.

9. The method of constructing a semi-permanent structural support system of claim 7, wherein each said end-plate is a bracket.

* * * * *